United States Patent [19]

Stewart

[11] Patent Number: 5,042,517

[45] Date of Patent: Aug. 27, 1991

[54] PORTABLE PROTECTIVE MEATHOUSE FOR FRESH-KILLED GAME

[76] Inventor: Larry E. Stewart, Box 757, Armstrong, B.C., Canada, V0E 1B0

[21] Appl. No.: 514,113

[22] Filed: Apr. 25, 1990

[51] Int. Cl.[5] ..... E04H 15/04

[52] U.S. Cl. ..... 135/90; 135/115

[58] Field of Search ..... 135/90, 103, 900, 901, 135/88, 115, 119; 5/121, 128

[56] References Cited

U.S. PATENT DOCUMENTS

| | | | |
|---|---|---|---|
| 613,865 | 11/1898 | Newton | 135/90 |
| 1,145,290 | 7/1915 | Brackshaw | 5/121 |
| 1,156,200 | 10/1915 | Ashworth et al. | 5/121 |
| 1,182,185 | 5/1916 | Lysons | 5/121 X |
| 1,343,800 | 6/1920 | Trimm | 135/90 X |
| 1,411,272 | 4/1922 | Eaton | 135/90 X |
| 2,301,089 | 11/1942 | Stevens | 135/901 X |
| 2,631,520 | 3/1953 | Geerling | 135/34 X |
| 2,820,468 | 1/1958 | Park et al. | 135/119 X |
| 3,441,037 | 4/1969 | Transeau | 135/119 X |
| 4,308,883 | 1/1982 | Malone | 5/121 X |
| 4,408,260 | 10/1983 | Miedel | 135/119 X |

*Primary Examiner*—David A. Scherbel
*Assistant Examiner*—Lan Mai
*Attorney, Agent, or Firm*—John J. Leavitt

[57] ABSTRACT

The enclosure for protecting fresh-killed game against contamination includes bottom side and end walls pervious to air and a top wall impervious to fluids including air and liquids. It is suspended by its gabled top wall from a support member that extends through the enclosure and is itself supported horizontally above the ground by a pair of vertically upright members.

12 Claims, 4 Drawing Sheets

PORTABLE PROTECTIVE MEATHOUSE FOR FRESH-KILLED GAME

BACKGROUND OF THE INVENTION

1. Field of the Invention.

This invention relates to protective enclosures of the type that discourage the entry of insects, and particularly to such an enclosure that will prevent the accessibility of flies and other flying insects to fresh-killed game or dressed meat.

2. Description of the Prior Art.

A preliminary patentability and novelty search was conducted in connection with the subject matter of this invention in Class 135, sub-classes 90, 116 and 117; and in Class 312, subclasses 6, 213, 245 and 258. As a result of such search the following United States patents were found to exist:

| | | |
|---|---|---|
| 613,865 | 1,343,800<br>1,411,272 | 2,631,520 |

Although the foreign prior art in the classes and subclasses indicated above was also searched, no additional pertinent prior art patents were found.

U.S. Pat. No. 613,865 conceptually relates to a portable screen structure capable of protecting against flies, mosquitos and other insects, but the construction of the portable screen structure taught by this patent is very different from the structure forming the subject matter of the instant invention.

U.S. Pat. No. 1,343,800 relates to a tent and hammock, illustrating a structure that is suspended above the ground for enclosing a hammock on which a person may sleep.

U.S. Pat. No. 1,411,272 discloses a "safe" specifically designed for the storage of fresh meat in the out-of-doors, and is adapted to be hung from a limb of a tree or other support. The fresh meat is deposited on the floor of the enclosure, with the enclosure supporting the weight of the meat. Important structural and functional differences exist between the disclosure by this patent and the subject matter of the instant invention.

U.S. Pat. No. 2,631,520 is also directed to a device for protecting a carcass, such as a recently killed deer, for instance. Thus, while the end result of protecting the carcass or fresh meat from flies and other insects may be achieved by this device, the structure by which this is achieved is significantly different from the structure forming the subject matter of the instant invention.

Those that are not accustomed to hunting wild game for food, or "dressing" a carcass in the out-of-doors, or even in dismembering a carcass to facilitate transporting it, are not usually aware that leaving fresh-killed game or fresh and raw meat exposed in the out-of-doors invites contamination of the meat by insects, particularly the so-called "blow fly" whose propensity is to lay eggs in the fresh meat, which subsequently hatch to become larvae that feed off the fresh meat.

It is important that fresh-killed game be "dressed" quickly in the field, and hung so that blood drains from the meat, and to give the meat a chance to cool below the natural body heat of the live animal.

It seems alsmost axiomatic that when wild game, such as deer, or elk are hunted and shot, the animal falls and dies in locations that at worst are inaccessible, and at best far from roadways accessible to vehicles and equipment to facilitate carrying the carcass to a location where it may be "dressed" and the meat immediately placed in cold storage. Accordingly, one of the objects of the present invention is the provision of a shelter that is light, thus being easy to carry by a hunter, and which is easy to erect at the site of a "kill" so that the animal killed may be quickly dressed out and dismembered into portions that may immediately be hung within the shelter for protection from flying insects, particularly "blow-flies."

After fresh meat has cooled in a protective shelter such as the one forming the subject matter of this invention, it is important to be able to wrap the meat in the material from which the protective shelter is formed, until the meat may be transported to cold storage facilities. Accordingly, another object of the present invention is the provision of a protective shelter for fresh-killed game that is sufficiently flexible that it may be wrapped about the dressed portions of meat to prevent access to the meat by insects during transport.

Because of the environment in which the portable protective meathouse is used, it will of course become soiled with blood and possibly dirt if it is permitted to come into contact with the ground. Accordingly, another object of the invention is the provision of a protective shelter for fresh meat that is non-absorbent and may be easily laundered to remove blood that may have adhered to it during use.

Still another object of the invention is the provision of a protective shelter for fresh-killed meat in which the shelter may be suspended from a horizontal support prior to the introduction of the fresh meat into the shelter, and the fresh meat portions then suspended within the shelter from the horizontal support without imposing any weight on the shelter.

The invention possesses other objects and features of advantage, some of which, with the foregoing, will become apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the portable protective meathouse or meat shelter of the invention comprises an enclosure formed from very light weight screen or mesh-type material having openings sufficiently small to prevent the passage of insects into the protective shelter. The shelter is formed by a bottom wall connected about its perimeter with side walls that extend away from the bottom wall and connect with a top wall that is formed from material that is impervious to moisture. The top wall is adapted to be draped over a horizontal support beam to support and form a gabled roof for the shelter. Opposite gabled ends of the shelter are generally configured as isosceles triangles, each of which forms an end wall portion of the shelter, being sewn to the upper edge of the associated generally rectangular end wall portion of the shelter. The apex end of each triangular end wall portion of the shelter is provided with a tubular extension through which the supporting beam may extend, and ties are provided on the extensions for tightly binding the tubular extensions to the support beam to prevent the entry of insects. One end wall of the shelter is provided with a zipper that extends through the associated triangular gable end wall of the shelter and through the associated tubular extension to thus permit opening of the shelter from one end and displacement of the opened end of the shelter toward the opposite end so that meat may be hung on the horizontal beam without reaching into the shelter, which is then drawn over the meat hung on the beam and zipped shut to prevent the entry of insects. Means are provided connected to the four upper corners of the side walls where they connect with the roof panel to retain the side walls laterally spaced apart so that the side and end walls of the protective shelter or enclosure are spaced from the meat hanging therein.

DESCRIPTION OF THE PREFERRED EMBODIMENT

In terms of greater detail, the portable protective meathouse or shelter of the invention comprises an enclosure designated generally by the numeral 2, and adapted when in use to be suspended from a support structure including a horizontal beam 3, which may conveniently be a tree limb cut for this purpose. The beam is arranged horizontally as shown between two vertical supports 4 and 5 that are spaced apart an appropriate distance and which may conveniently be a pair of trees. The horizontal beam 3 is appropriately lashed by appropriate cords 6 to the vertical supports to support the beam at a predetermined height above the ground.

It should be understood that while I have illustrated the use of a tree limb for the horizontal beam, and the use of existing trees to support the beam, other appropriate supports may be used to suspend the enclosure. Thus, there are areas where wild game is hunted and killed where there are no trees from which a support may be formed. In such circumstances, the support structure may be formed from appropriate metal or wood rods carried for that purpose by the hunter and which perform the same function as the horizontal beam and the trees illustrated and described herein.

Figure 1:
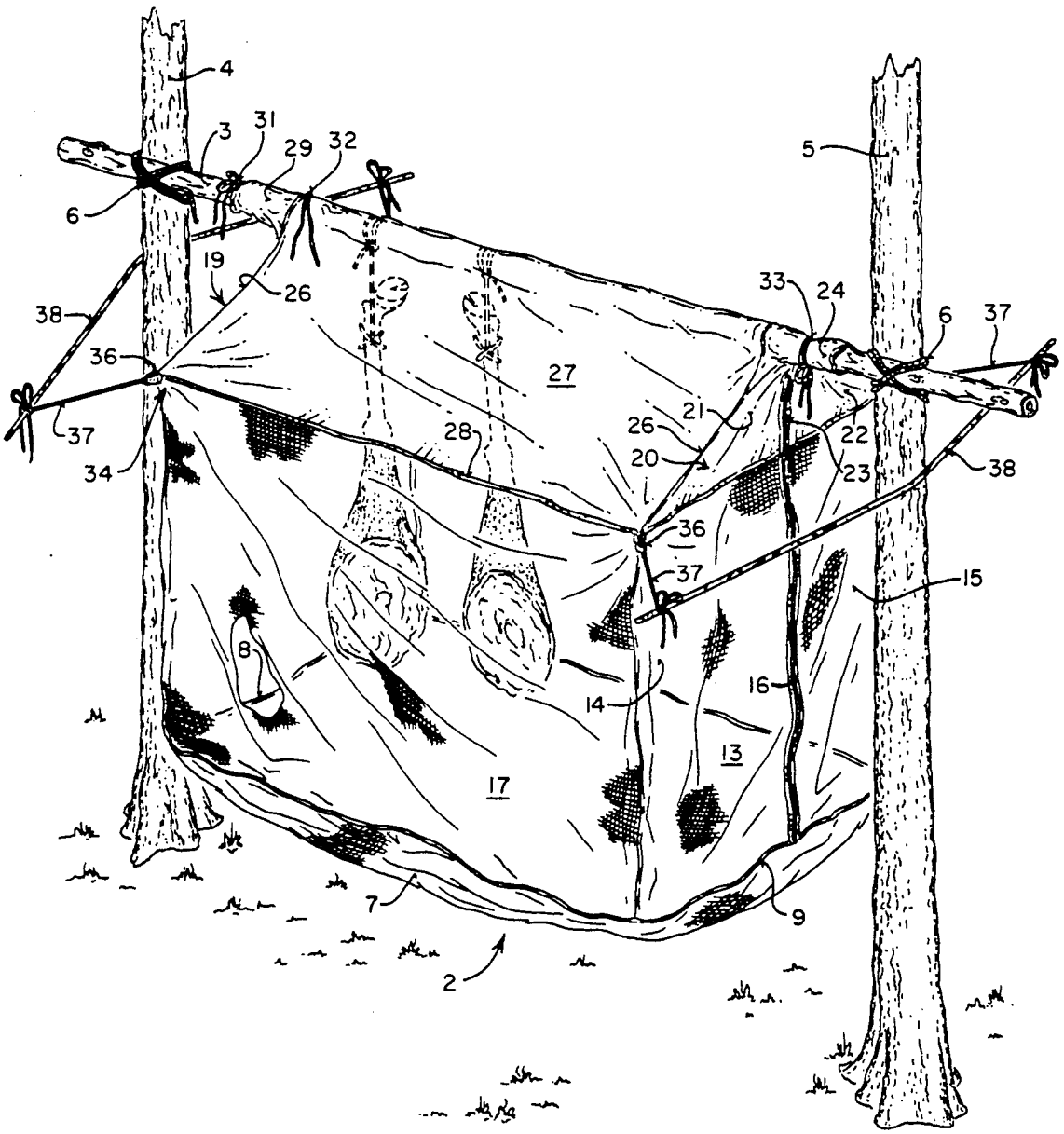
FIG. 1 is a perspective view illustrating the portable protective meathouse or shelter of the invention in position of use suspended from a horizontal beam lashed between two trees.
Figure 2:
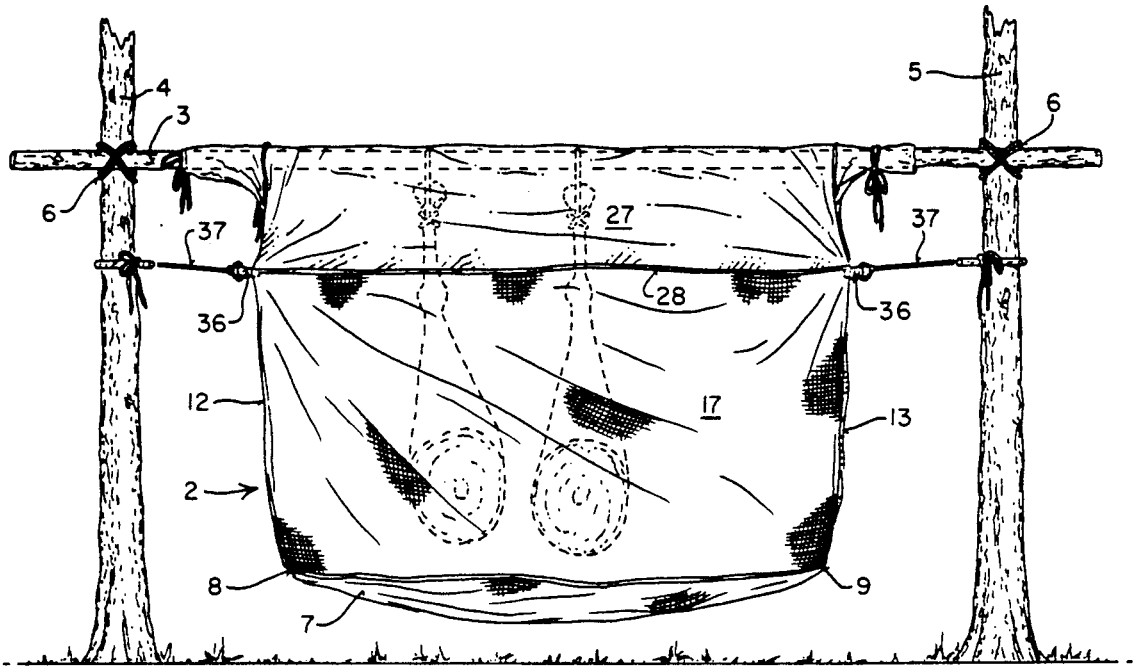
FIG. 2 is a side elevational view of the portable protective meathouse or shelter suspended in position of use.

Referring to FIG. 1, it will there be seen that the protective enclosure comprises a bottom panel 7 that is generally rectangular, about 3' wide and 5' long, and formed from a woven material that is sufficiently tightly woven to provide strength in the material and permit it to be sewn to itself by appropriate stitching, yet woven to provide openings of sufficient size to permit the passage and circulation of air through the material while being sufficiently small to prevent the passage of insects through the material and into the enclosure. Preferably, the material is woven from a synthetic resinous filament that is tough and non-absorbent. I have found that mosquito netting formed from Nylon provides very satisfactory results.

Figure 3:
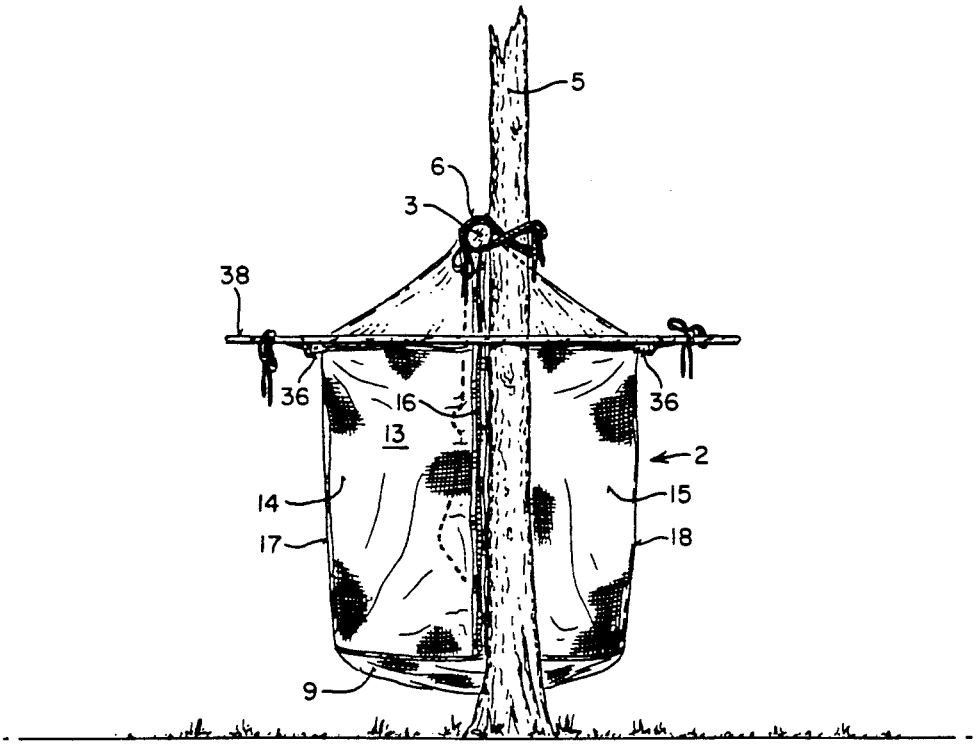
FIG. 3 is an end elevational view of the portable protective meathouse suspended in position of use.
Figure 5:
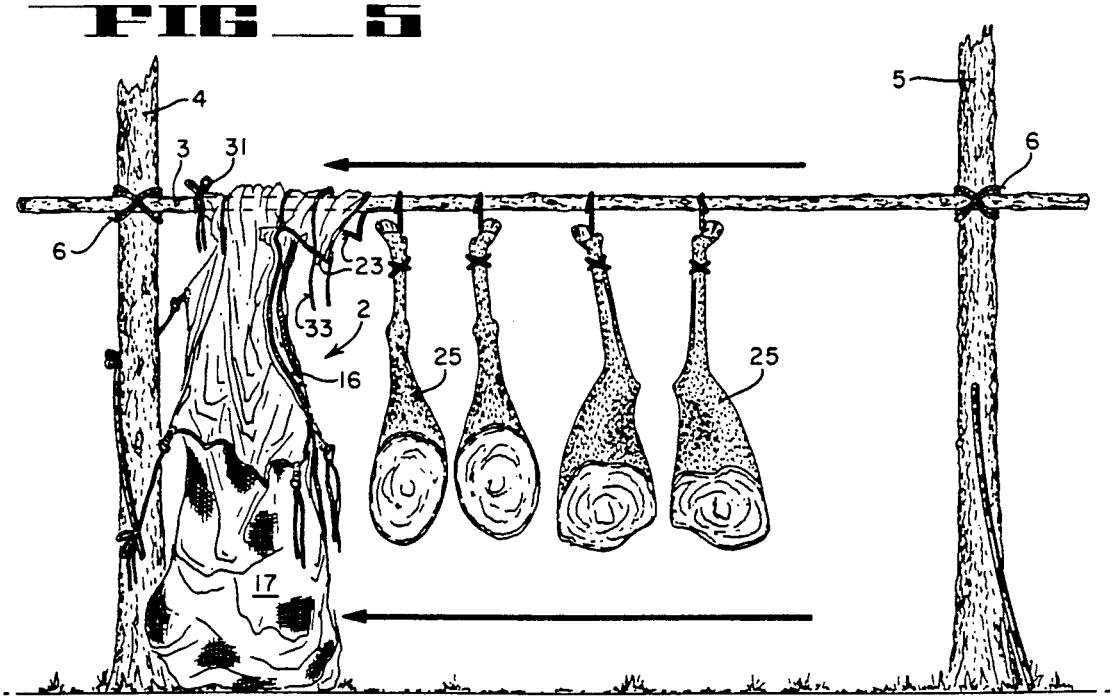
FIG. 5 is a side elevational view of the protective shelter illustrating the zippered end of the shelter opened and the shelter slid to the left on the support beam so as to enable suspension of the fresh meat portions directly from the beam without the need of reaching into the shelter.

Sewn to opposite end edges 8 and 9 of the bottom panel are end panels 12 and 13, formed from the same material as the bottom panel, with each of the end panels being about 2' high and 3' wide and forming an end of the enclosure. As seen in FIGS. 1, 3 and 5, the end panel 13 is formed from two half panels 14 and 15 joined medianly by a zipper 16, preferably formed from an appropriate non-corrosive synthetic resinous material such as Nylon. The zipper extends the full height of the panel 13 as shown, and extends beyond the panel, as will hereinafter be explained.

The opposite side edges of the end panels 12 and 13 are preferably parallel and are sewn appropriately to the end edges of side wall panels 17 and 18, each being of the same height as the end wall panels and of the same length as the bottom panel, with the bottom edge of the side wall panels sewn to the lateral edges of the bottom panel, thus forming a generally rectangular box-like enclosure when assembled with the end panels and the bottom panel as shown.

Figure 4:
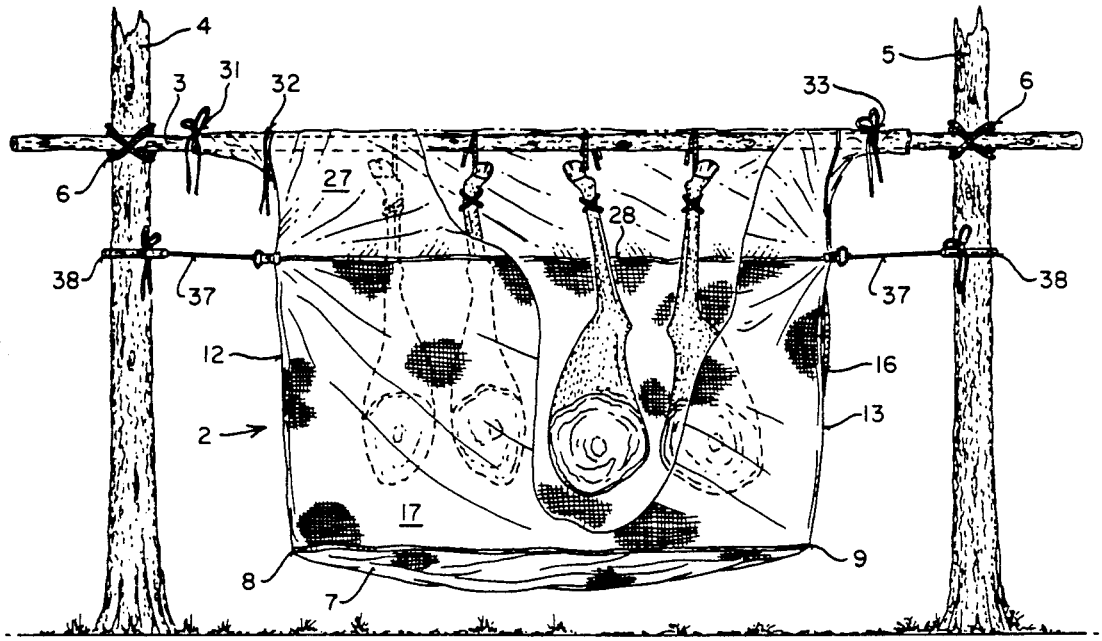
FIG. 4 is a side elevational view with a portion of a wall broken away to illustrate the manner in which fresh meat may be suspended within the enclosure on the support beam without imposing any weight on the enclosure.

The upper edges of the end wall panels and side wall panels 13 and 14 are sewn appropriately to the base edge of triangular gable end panels 19 and 20, respectively, the gable end panel 20 being formed in two parts 21 and 22 joined medianly by a zipper extension 23 that forms a continuation of the zipper 16 that medianly joins the end panel portions 14 and 15 of end panel 13. At its apex end, the triangular gable panel 20 is sewn to a laterally extending tubular member 24, and the zipper 23 continues uninterrupted through the length of the tubular member 24 as illustrated in FIG. 5, thus enabling the zipper 16 and its extension 23 to selectively open or close the entire end of the shelter. As illustrated in FIG. 1, the zipper is closed and the end of the enclosure is also enclosed to prevent the ingress of insects. As illustrated in FIG. 5, the zipper is open thus permitting the entire enclosure to be slid to the left along the supporting beam 3 so that portions 25 of the fresh killed meat may be appropriately supported on the cross beam 3 prior to the shelter material being drawn over the beam to the right and fastened as indicated in FIG. 4.

Figure 6A:
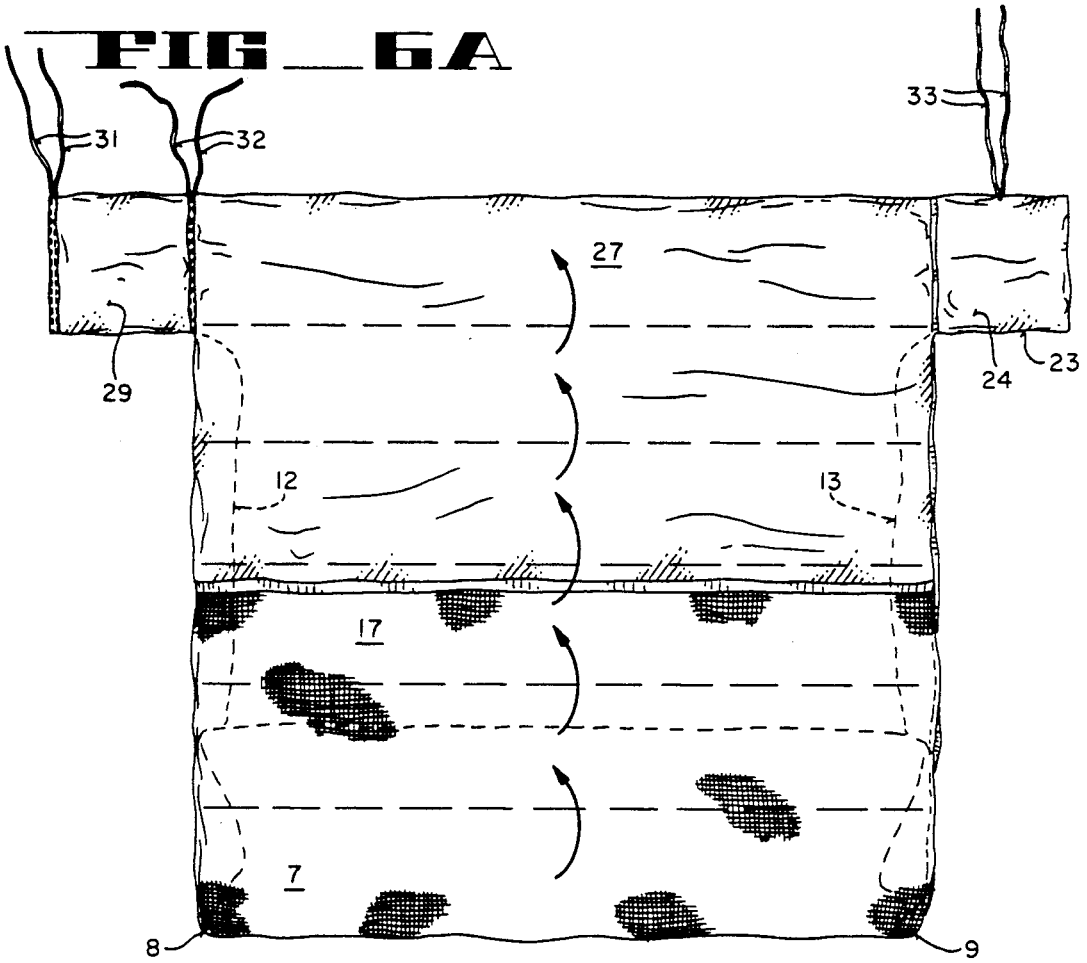
FIG. 6A is a plan view illustrating the portable protective meathouse or shelter apart from the support structure and illustrated in extended form.
Figure 6B:
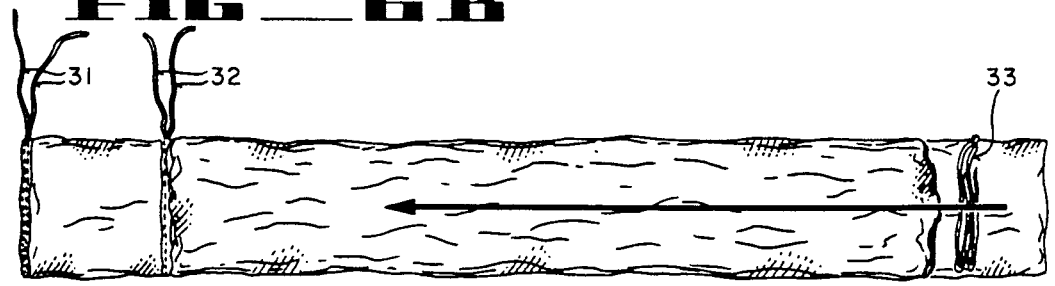
FIG. 6B is a plan view illustrating the protective shelter folded or rolled from the bottom or floor toward the roof panel and the laterally extending tubular members in preparation of compression of the shelter into one of the tubular members for storage.
Figure 6C:
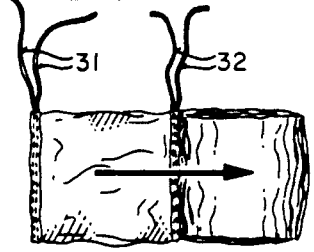
FIG. 6C illustrates the shelter compressed and partially inserted into one of the tubular extensions.
Figure 6D:
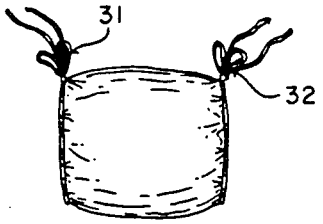
FIG. 6D illustrates the shelter compressed and completely inserted into one of the laterally extending tubular extensions and the drawstrings which comprise ties to enclose the shelter in its own sheath for storage.

Each of the triangular gable panels 19 and 20 are sewn along their converging edges 26 to the associated end edges of a moisture impervious roof panel 27 that is adapted to extend over the support beam 3, with lateral side edges 28 of the roof panel 27 being sewn tightly to the upper edges of the side wall panels 17 and 18. As illustrated in FIG. 1, and also in FIG. 6A, the laterally extending tubular portion 24 is also sewn medianly to the roof panel 27, and at the opposite end of the enclosure, the lateral extension 29 also constitutes a tubular extension one end of which is sewn both to the end panel 19 and medianly to the roof panel 27 as shown. Appropriate ties 31 and 32 are provided at opposite ends of the tubular extension 29 as shown, while with respect to the tubular extension 24 at the opposite end of the shelter, ties 33 are provided medianly of the extension 24 to bind the extension tightly to the beam 3 to prevent the passage of insects into the enclosure along the beam. The reason there are two tie sets 31 and 32 associated with the tubular extension 29 is to draw the ends of the tubular member 29 tightly together when the shelter is enclosed as illustrated in FIG. 6D.

To retain the side wall 17 and 18 and the roof panel 27 distended as illustrated in FIG. 1, each of the upper corners where the side panels and end panels intercept with the corners of the roof panels 27, is provided with a loop 36 to which is tied a tether 37. Thus, as illustrated in FIG. 1, the ends of the tethers 37 may be tied to a bow or strut 38 at each end of the shelter, the strut 38 passing behind the vertical supports 4 and 5 as shown, and preferably having a measure of resilience so as to retain the tethers 37 taut as shown. The ends of the tethers 37 are tied as shown to the strut so that they may be easily released yet are secure so long as it is desired that the shelter remain in extended position as illustrated in the drawings.

Having thus described the invention, what is believed to be new and novel and sought to be protected by letters patents of the United States is as follows:

I claim:

1. A portable protective shelter for fresh-killed game meat to minimize the opportunity for contamination of the meat by insects, including flies, said shelter being adapted to be suspended above ground level from a rigid horizontal support member supported above ground level by vertically extending support members, comprising:

a) a generally rectangular box-like enclosure having four corners and formed by joined bottom wall and spaced side and end walls of material pervious to air, said side and end walls at a plane remote from the plane of said bottom wall joined by a top wall adapted to be draped over said horizontal support member to define and support said enclosure within which meat may be suspended above ground level;

b) means including a horizontal strut connecting opposite corners of said shelter at each end thereof and lying in said plane remote from the plane of said bottom wall to retain said side walls spaced apart; and c) means mounted on at least one of said end walls selectively manipulable to open or close an opening in said end wall to facilitate drawing the shelter over meat suspended on said horizontal support member whereby said meat is suspended in said enclosure and is exposed to the circulation of air through the enclosure to effect cooling of the meat but is protected from contamination by insects.

2. The portable protective shelter as defined in claim 1, in which said bottom, side and end walls are fabricated from a non-absorbent synthetic resinous material.

3. The portable protective shelter as defined in claim 1, in which said top wall is impervious to moisture.

4. The portable protective shelter as defined in claim 1, in which said means mounted on at least one of said end walls selectively manipulable to open or close an opening in said end wall comprises a non-corrosive zipper.

5. The portable protective shelter as defined in claim 4, in which said zipper extends from said bottom wall to said top wall.

6. The portable protective shelter as defined in claim 1, in which each said end wall includes a triangular gable portion having convergent edges sewn to said top wall whereby when said enclosure is suspended from said horizontal support member said top wall forms a gabled roof for said enclosure.

7. The portable protective shelter as defined in claim 1, in which said means including a strut connecting opposite corners of said shelter comprise tethers each connected by one end to a corner of said enclosure and connected at its opposite end to said strut in a manner to retain said tethers taut.

8. A portable protective shelter for fresh-killed game meat to minimize the opportunity for contamination of the meat by insects, including flies, said shelter being adapted to be suspended above ground level from a horizontal support member supported above ground level by vertically extending support members, comprising:

a) a generally rectangular box-like enclosure having four corners and formed by joining bottom wall and spaced side and end walls of material pervious to air, said side and end walls at a plane remote from the plane of said bottom wall joined by a top wall adapted to be draped over said horizontal support member to define and support said enclosure within which meat may be suspended;

b) means including a strut connecting opposite corners of said shelter at each end thereof and lying in said plane remote from the plant of said bottom wall of retain said side walls spaced apart;

c) means mounted on at least one of said end walls selectively manipulable to open or close an opening in said end wall to facilitate drawing the shelter over meat suspended on said horizontal support member whereby said meat is suspended in said enclosure and is exposed to the circulation of air through the enclosure to effect cooling of the meat but is protected from contamination by insects;

d) tubular extensions on said end walls extending coaxially about said horizontal support member when said shelter is suspended thereon; and e) tie means on said extensions selectively manipulable to bind said extensions tightly about said support member whereby insects are prevented from entering said enclosure through said extensions.

9. The portable protective shelter as defined in claim 8, in which said tubular extensions are open at opposite ends and communicate with the interior of said enclosure.

10. The portable protective shelter as defined in claim 8, in which said tie means on one of said tubular extensions constitute a pair of spaced drawstrings selectively manipulable to decrease the diameter of the tubular extension where the drawstring is located, while the tie means on the other tubular extension is adapted to be selectively wrapped about the tubular extension to bind the tubular extension about the horizontal support member.

11. A portable protective shelter for fresh-killed game meat to minimize the opportunity for contamination of the meat by insects, including flies, said shelter being adapted to be suspended above ground level from a horizontal support member supported above ground level by vertically extending support members, comprising:

a) a generally rectangular box-like enclosure having four corners and formed by permanently joined bottom wall and spaced side and end walls of material pervious to air, said side and end walls at planes remote from the plane of said bottom wall permanently joined by a top wall adapted to be draped over and with the associated end walls sealingly secured to said horizontal support member to define and sealingly support said enclosure against the entry of insects and within which meat may be suspended above ground level without imposing the weight of the meat on the enclosure;

b) means including a strut connecting opposite corners of said shelter at each end thereof and lying in a plane parallel and remote from the plane of said bottom wall to selectively retain said side walls spaced apart; and c) means mounted on at least one of said end walls selectively manipulable to open or sealingly close an opening in said end wall adjacent said horizontal support member to facilitate projection of the horizontal support member therethrough and drawing of the shelter over meat suspended on said horizontal support member whereby said meat may be suspended in said enclosure exposed to the circulation of air through the enclosure to effect cooling of the meat while protected from contamination by insects.

12. The portable protective shelter as defined in claim 11, in which said means mounted on at least one of said end walls selectively manipulable to open or sealingly close an opening through said end wall includes ties manipulable to seaingly bind the end wall to the projection of the support member through the end wall.

* * * * *